US005460742A

United States Patent [19]

Cavanagh et al.

[11] Patent Number: 5,460,742

[45] Date of Patent: Oct. 24, 1995

[54] AQUEOUS ACIDIC HARD SURFACE CLEANER WITH ABRASIVE

[75] Inventors: James W. Cavanagh, Ramsey, N.J.; Robert P. Manzo, Chester, N.Y.

[73] Assignee: Reckitt & Colman Inc., Montvale, N.J.

[21] Appl. No.: 64,293

[22] Filed: May 18, 1993

[51] Int. Cl.[6] ..... C11D 3/14; C11D 3/30; C11D 3/33; C11D 17/00

[52] U.S. Cl. ..... 252/144; 252/171; 252/173; 252/174.21; 252/174.25; 252/547; 252/DIG. 14

[58] Field of Search ..... 252/174.25, 143, 252/144, 145, 174.21, 174.22, 547, DIG. 14, 171, 173

[56] References Cited

U.S. PATENT DOCUMENTS

| | | | |
|---|---|---|---|
| 2,672,449 | 3/1954 | Snell et al. | 252/100 |
| 3,214,380 | 10/1965 | Gangwisch | 252/100 |
| 3,882,038 | 5/1975 | Clayton et al. | 252/164 |
| 3,966,432 | 6/1976 | Rayner | 51/308 |
| 3,997,460 | 12/1976 | Sirine et al. | 252/106 |
| 4,124,523 | 11/1978 | Johnson | 252/145 |
| 4,501,680 | 2/1985 | Aszman et al. | 252/142 |
| 4,532,066 | 7/1985 | Paszek et al. | 252/144 |
| 4,561,993 | 12/1985 | Choy et al. | 252/174.25 |
| 4,842,771 | 6/1989 | Rörig et al. | 252/547 |
| 4,960,534 | 10/1990 | Smith et al. | 252/145 |
| 5,076,955 | 12/1991 | Ussat et al. | 252/142 |
| 5,078,896 | 1/1992 | Rörig et al. | 252/102 |

FOREIGN PATENT DOCUMENTS

| | | |
|---|---|---|
| 0214540 | 3/1987 | European Pat. Off. . |
| 2809371 | 9/1978 | Germany . |
| 56-155300 | 12/1981 | Japan . |
| 6184-599 | 9/1985 | Japan . |

*Primary Examiner*—Paul Lieberman
*Assistant Examiner*—Ardith Hertzog
*Attorney, Agent, or Firm*—J. Jeffrey Hawley; Frederick H. Rabin

[57] ABSTRACT

Aqueous acidic thixotropic hard surface cleaning formulations, having a viscosity of 2000 to 10,000 centipoise containing on a weight to weight basis:

(a) 0.5 to 6.0 percent of hydrated aluminum silicate that is substantially free of inert mineral impurities;

(b) 0.1 to 3.0 percent of an amphoteric material or a highly alkoxylated block copolymer;

(c) 0.1 to 5.0 percent of a nonionic surfactant selected from the group consisting of polyoxyethylene derivatives of higher alcohols and polyethylene glycol ethers of linear alcohol;

(d) sufficient acid to establish a pH in the range 0.9 to 3.5;

(e) 5.0 to 50.0 percent of an abrasive;

(f) 1.0 to 5.0 percent of a cleaning solvent; and (g) sufficient deionized water to make 100 percent.

4 Claims, No Drawings

AQUEOUS ACIDIC HARD SURFACE CLEANER WITH ABRASIVE

FIELD OF THE INVENTION

This invention relates to the field of hard surface cleansers, in particular to a formulation and method for performing such cleaning.

BACKGROUND OF THE INVENTION

Liquid abrasive hard surface cleaners are typically based on alkaline formulations incorporating calcium carbonate as the abrasive. Leading products on the market have pH ranges from 8 to 12.5 with the higher end of this range having bleach incorporated in the formulation to efficiently remove food stains. These formulations are not formulated to remove bathroom soils such as soap scum, rust and mineral stains.

U.S. Pat. No. 4,532,066, Paszek et al. discloses a polishing cleanser, having a pH of 3 to 4.5, and comprising 8 to 20% of a polishing agent, from about 1 to 5% of a nonionic surfactant, from about 1 to 2.25% of a thickening agent , an oxalate salt and sufficient water to make 100 weight percent. This formulation will not efficiently clean lime soap, mineral deposits and rust stains from household hard surfaces.

SUMMARY OF THE INVENTION

The present invention provides a stable clay containing acidic formulation in which a combination of amphoteric materials or certain highly alkoxylated block copolymers, and an alcohol ethoxylate acts synergistically with hydrated aluminum silicate having a cation exchange capacity of 80 to 120 meq/100 g, preferably 100 to 120 meq/100 g, to produce a thixotropic system capable of suspending abrasive particles during extended periods of storage. The formulations will remove bathroom soils, such as soap scum, rust, and mineral stains. These cleaners will adhere to vertical surfaces because of their thixotropic characteristics and can provide good cleaning and high germicidal activity.

The formulations of the present invention are aqueous acidic thixotropic hard surface cleaning formulations, having a viscosity of 2000 to 10,000 centipoise, preferably 2500 to 7000 centipoise, and comprising, on a weight to weight basis:

(a) 0.5 to 6.0 percent of hydrated aluminum having a cation exchange capacity of 80 to 120 meq/100 g, preferably 100 to 120 meq/100 g;

(b) 0.1 to 3.0 percent of an amphoteric material or a highly alkoxylated block copolymer;

(c) 0.1 to 5.0 percent of a nonionic surfactant selected from the group consisting of polyoxyethylene derivatives of higher alcohols and polyethylene glycol ethers of linear alcohol;

(d) sufficient acid to establish a pH in the range 0.9 to 3.5;

(e) 5.0 to 50.0 percent of an abrasive;

(f) 1.0 to 20.0 percent of a cleaning solvent; and (g) sufficient deionized water to make 100 percent.

DETAILS OF THE INVENTION

Research into the function of components in the formulation of the invention show that there are four essential components, in addition to water, that combine to create a thickened formulation having a viscosity, of 2000 to 10,000 cps, capable of suspending abrasive particles. Omission of any one of these components causes the viscosity to be outside of this range. Embodiments of the invention containing amine oxides maintain a stable viscosity over time, a characteristic that has typically eluded clay thickened systems in the past as acknowledged by Choy in U.S. Pat. No. 4,561,993.

The key components necessary to achieve the above viscosity are:

hydrated aluminum silicate that is substantially free of inert mineral impurities;

an amphoteric material such as an amine oxide or a highly alkoxylated block copolymer;

a nonionic surfactant; and an acid.

The viscosity of 2000 to 10,000 cps is sufficient to suspend abrasive particles uniformly throughout the cleaner. This viscosity is stable over a long period of time. If the viscosity is less than 2000 the formulation is defective in that it exhibits a tendency for the settling out of the abrasive particles. If the viscosity is greater than 7000 to 10,000 the formulation is defective in that it is more difficult to dispense as a flowable liquid. The preferred viscosity of 2500 to 7000 is sufficient to cause the formulation to adhere to a smooth vertical surface where hard water, iron and/or organic stains might be found inside of a toilet bowl, lavatory, tub, etc. The adherence of the cleaner to the vertical surfaces is important since the acid present can most effectively attack the hard water and/or iron salts comprising a portion of the stains. In addition, the high viscosity keeps the abrasive agent adjacent to the stains and available for scrubbing contact therewith.

The hydrated aluminum silicate must have a cation exchange capacity of 80 to 120 meq/100 g, preferably 100 to 120 meq/100 g. Such silicate has sufficient cation exchange sites available for interaction with the amphoteric material to promote achievement and stabilization of the viscosity in the range 2000 to 10,000 cps. Any hydrated aluminum silicate, in combination with the amphoteric material, that fails this test is not suitable for use in this invention. This requirement provides an objective test for one skilled in the art to identify useful silicates. The importance of the availability of sufficient cation exchange sites is demonstrated by the negative impact that ordinary tap water has on the viscosity of the formulations. The affinity of the exchange sites for calcium and magnesium in tap water is much stronger than the affinity for the amphoteric surfactants. Thus lower viscosity formulations are obtained when tap water is used instead of deionized water.

A highly purified grade of montmorillonite clay, having a cation exchange capacity 100 to 120 meq/100 gin, is provided commercially as Mineral Colloid BP, is particularly useful. Other suitable hydrated aluminum silicates that can be purified sufficiently to provide the required cation exchange capacity are well known in the art as belonging to the smectite class of clay minerals.

Amphoteric materials such as amine oxides and highly alkoxylated block copolymers are also essential to establishing the desired viscosity. Amine oxide materials are preferred.

Amphoteric amine oxides stabilize viscosity and also improved the rinsability of the formulations from hard surfaces. It is believed that the amine oxide develops a slight positive charge at low pH which causes its absorption onto the hydrated aluminum silicates surface, resulting in steric stabilization of the dispersion. Useful amine oxides are those sold under the tradename Barlox (Lonza, Inc.) and Ammonyx (Stepan Company). These compounds are representative of the broader class of alkyl dimethyl amine oxides such as lauryl dimethyl amine oxide used in the examples to illustrate the invention. Also useful are alkyl amido amine oxides such as cocamidopropylamine oxide (Barlox C). Other useful amphoteric surfactants include betaine derivatives such as cocoamidopropyl betaine (Velvetex BA-35 - Henkel Corp.) and cocobetaine (Mackam CB-35-McIntyre Group Ltd.).

Useful highly alkoxylated block copolymers include those sold under the trade names Pluronics® and Tetronics®. Generically Pluronics® polymers are $HO(CH_2CH_2O)_x(CH_3CHCH_2O)_y(CH_2CH_2O)_zH$ or $HO(CHCH_3CH_2O)_x(CH_2CH_2)_y(CHCH_3CH_2O)_zH$. Tetronics® are derived from the block copolymerization of ethylenediamine. Pluronic L92, used in the examples conforms to the formula $HO(CH_2O)_x(CH_3CHCH_2O)_y(CH_2CH_2)_zH$ where the average value of x, y and z are 10, 47, and 10 respectively. It is theorized that these block copolymers do not interact ionically with the thickening system, as do the amphoteric materials, but rather through steric interaction due to their high molecular weights.

The use of an acid in the formulation is essential in that it induces a change in the surface charge of the clay by lowering the pH to 0.9 to 3.5. This phenomenon, which can be induced in a number of ways, causes the clay platelets to align in an edge to face manner creating a "house of cards" structure thereby inducing an increase in viscosity. This technique is practiced by those skilled in the art of clay thickened systems. In this formula however, it is surprising that no thickening occurs even with the acid if one of the essential components has been excluded. This indicates a synergistic interaction between the essential components that is not predictable from the individual properties of the key components. It is theorized that the surfactants interact to sterically stabilize the house of cards structure thereby contributing to increasing the viscosity of the formulation. Useful acids include oxalic, citric, glycolic, sulfamic, hydrochloric and phosphoric. Oxalic acid is preferred because of its capacity for rust removal and mild acid properties.

Organic solvents such as dipropylene glycol methyl ether, diethylene glycol monobutyl ether, ethylene monobutyl ether and others known by those skilled in the art of hard surface cleaner formulations can also be used. The dipropylene glycol methyl ether and the propylene glycol used in the examples function as cleaning aids. In addition to cleaning benefits they also improve freezing stability and rinsing properties from hard surfaces. Both of these components cause a slight increase in viscosity of the formulations of the invention.

A variety of nonionic surfactants from the polyoxyethylene of higher alcohol class, such as NEODOL® can be used. Found particularly suitable are polyoxyethylene derivatives of higher alcohols, such as NEODOL® 23-6.5 which is based on Shell Chemical Company's primary $C_{12}$–$C_{13}$ Detergent Alcohol (NEODOL® 23) and has an average of 6.5 ethylene oxide (EO) units per alcohol mole (about 59% w/w EO). Other illustrative suitable nonionic surface active agents are Union Carbide's polyethylene glycol ether of linear alcohol (9 moles EO).

The abrasive component of the formulation is necessary for physically scouring the stains from surfaces. The abrasive agent should be present in amounts of from about 5 to 50% by weight of the composition. Any suitably acid stable abrasive agent may be used, although silicon dioxide is preferred because of its ready availability and low cost. The abrasive agent particle size should be quite small, i.e., from about 40 to about 400 mesh (with a preferred size being where greater than 99 percent of the particles are smaller than 325 mesh). In such particle range, the abrasive is readily suspended in the homogenous stable liquid dispersion, yet, the particles are large enough to provide adequate scouring properties. Other acid inert, abrasive agents such as, for example, kaolin, pumice, diatomite, tripoli, siliceous clay, etc., may be partially or completely substituted for the silicon dioxide. Very useful abrasive agents are silica or silicon dioxide having a median particle size of about 5.8 microns and having a particle size distribution of about 2–10 microns, e.g., Tamsil 30 (Unimin specialty Minerals, Inc.) with a sieve analysis of 99.6% of the particles passing through a 325 mesh screen. This preferred abrasive agent in the cleanser of the invention imparts polishing but no scratching action to even delicate hard surfaces. Also acceptable for use herein is an abrasive agent of slightly larger particle size such as silicon dioxide having an average particle size up to about 10 microns and having a particle size distribution of about 1 to 40 microns, e.g., "19 Silica" (Whitaker, Clark and Daniels, Inc.) of particle size 99% less than 40 microns, 98% less than 20 microns, 77% less than 15 microns, 62% less than 10 microns, 40% less than 5 microns, 36% less than 4 microns, 22% less than 2 microns and 14% less than 1 micron.

In addition to the above-described essential components, there may be added other adjuvants which contribute desirable properties to the cleanser and which do not detract from the cleansing or polishing properties of the formulation or lessen its stability. For example, fragrances, dyes, fluorescent materials, propellants (for preparing pressurized compositions), and other compatible additional materials for furthering or enhancing the action of any of the said essential ingredients may be added, provided they would not detract from the desired properties of the cleanser in the relatively minor amounts in which they would be used.

The range of formulations of the invention are described Table 1 below for representative components.

TABLE 1

| | | Preferred | Range |
|---|---|---|---|
| PART A | DI WATER | 64.14% | 40.0–65.0% |
| | MINERAL COLLOID BP | 2.0 | 0.1–6.0 |
| | ATLAS WHITE 9985 | 1.0 | 0.1–2.0 |
| | TAMSIL 30 | 10.0 | 5.0–50.0 |
| PART B | PROPYLENE GLYCOL | 10.0 | 1.0–20.0 |
| | BARLOX 12 (30%) | 2.0 | 0.3–5.0 |
| | NEODOL 23-6.5 | 2.0 | 0.5–5.0 |
| | DOWICIDE I (63%) | 0.16 | 0.02–0.2 |
| | ARCOSOLVE DPM | 4.5 | 1.0–5.0 |
| | FRAGRANCE | 0.2 | 0.1–0.5 |
| PART C | OXALIC ACID | 4.0 | 1.0–6.0 |

The formulations are prepared in separate parts A, B and C and then combined.

First part A is prepared by combining Mineral Colloid BP in water by mixing at high speed with a propeller blade for 20 to 30 minutes. After Colloid BP is hydrated, it is move to a homogenizing mixer and then Atlas White and Tamsil 30 are added. Mixing at a moderate speed is continued to promote dispersion of the particles.

Part B is prepared by adding ingredients in the order listed in table 1 to the propylene glycol. Each component is allowed to mix in completely before adding the next . Mixing should be done at low speed to prevent excessive foam generation. Mixing is continued until a clear solution is obtained.

Part C is added to the main batch (Parts A+B) as a crystalline powder.

Add part B to part A in a homogenizer and mix for 10 minutes. Part C is then added rapidly to the mixture of parts A and B. The homogenizer speed is increased as viscosity of the batch builds.

A deaeration step can be utilized to increase the density of the formulation.

EXAMPLES OF THE INVENTION

Table 2 shows examples 1–3 of this invention having viscosity's within the range of this invention. The unexpected synergism of the invention is shown by comparison examples 1–3 also in Table 2. Each of the comparison examples omit one of the essential components and as a result fails to achieve the desired viscosity.

TABLE 2

| COMPONENT | Ex. 1 (invention) | Ex. 2 (invention) | Ex. 3 (invention) | comparative ex. 1 | comparative ex. 2 | comparative ex. 3 |
|---|---|---|---|---|---|---|
| DI WATER | 63.89 | 73.89 | 68.39 | 66.14 | 65.89 | 65.89 |
| COLLOID BP | 2.25 | 2.25 | 2.25 | — | 2.25 | 2.25 |
| ATLAS WHITE | 1.00 | 1.00 | 1.00 | 1.00 | 1.00 | 1.00 |
| TAMSIL 30 | 10.00 | 10.00 | 10.00 | 10.00 | 10.00 | 10.00 |
| PROPYLENE GLYCOL | 10.00 | — | 10.00 | 10.00 | 10.00 | 10.00 |
| BARLOX 12 | 2.00 | 2.00 | 2.00 | 2.00 | — | 2.00 |
| NEODOL 23-6.5 | 2.00 | 2.00 | 2.00 | 2.00 | 2.00 | — |
| DOWICIDE I 63% | 0.16 | 0.16 | 0.16 | 0.16 | 0.16 | 0.16 |
| ARCOSOLVE DPM | 4.50 | 4.50 | — | 4.50 | 4.50 | 4.50 |
| FRAGRANCE | 0.20 | 0.20 | 0.20 | 0.20 | 0.20 | 0.20 |
| OXALIC ACID | 4.00 | 4.00 | 4.00 | 4.00 | 4.00 | 4.00 |
| VISCOSITY IN CPS | 5400 | 4300 | 4800 | separated | 500 | 160 |

*formulations in weight %
**viscosity in cps Brookfield model LVTD @ spindle 4, 60 rpm, read at 6 minutes, 25° C.

The chemical names and function of the components in the above formulations are given below in Table 3.

TABLE 3

| COMPONENT | CHEMICAL NAME | FUNCTION |
|---|---|---|
| DI WATER | — | |
| COLLOID BP | montmorillonite clay | thickener |
| ATLAS WHITE | titanium dioxide | whitening agent |
| TAMSIL 30 | silicon dioxide | abrasive |
| PROPYLENE GLYCOL | — | rinse aid/stabilizer |
| BARLOX 12/AMMONYX LO | lauryl dimethyl amine oxide | surfactant |
| PLURONIC L92 | block copolymer of EO and PO | surfactant |
| NEODOL 23-6.5 | alcohol ethoxylate | surfactant |
| DOWICIDE I 63% | orthophenyl phenol | disinfectant |
| ARCOSOLVE DPM | dipropylene glycol methyl ether | cleaning solvent |
| FRAGRANCE | mixture | perfume |
| DI WATER | — | |

TABLE 3-continued

| COMPONENT | CHEMICAL NAME | FUNCTION |
|---|---|---|
| OXALIC ACID | — | cleaning aid |

The invention has been described in detail with particular reference to preferred embodiments thereof, but it will be understood that variations and modifications can be effected within the spirit and scope of the invention.

We claim:

1. An aqueous acidic thixotropic hard surface cleaning formulation, having a viscosity of from 2500 to 7000 cps, comprising:

(a) 0.5 to 6.0 percent of hydrated aluminum silicate having a cation exchange capacity of 100 to 120 meq/100 g;

(b) 0.1 to 3.0 percent of an amphoteric material selected from the group consisting of an amine oxide and a betaine derivative;

(c) 0.1 to 5.0 percent of alcohol ethoxylate nonionic surfactant;

(d) sufficient oxalic acid to establish a pH in the range of 0.9 to 3.5;

(e) 5.0 to 50 percent of a silicon dioxide abrasive;

(f) 1.0 to 20 percent of dipropylene glycol methyl ether; and (g) sufficient deionized water to make 100 percent.

2. The formulation of claim 1 wherein the amine oxide is lauryl dimethyl amine oxide.

3. The formulation of claim 1 wherein:

(a) the hydrated aluminum silicate is present in an amount of 2.0 percent;

(b) the amphoteric material is lauryl dimethyl amine oxide and is present in an amount of 0.6 percent;

(c) the alcohol ethoxylate nonionic surfactant is present in an amount of 2.0 percent;

(d) the silicon dioxide is present in an amount of 10.0 percent; and (f) the dipropylene glycol methyl ether is present in an amount of 4.5%.

4. A method for cleaning hard surfaces comprising the steps of (I) providing a composition having a viscosity of from 2,500 to 7,000 cps which comprises:

(a) 0.5 to 6.0 percent of hydrated aluminum silicate having a cation exchange capacity of 100 to 120 meq/100 g;

(b) 0.1 to 3.0 percent of an amphoteric material selected from the group consisting of an amine oxide and a betaine derivative;

(c) 0.1 to 5.0 percent of alcohol ethoxylate nonionic surfactant;

(d) sufficient oxalic acid to establish a pH in the range of 0.9 to 3.5;

(e) 5.0 to 50 percent of a silicon dioxide abrasive;

(f) 1.0 to 20 percent of dipropylene glycol methyl ether; and (g) sufficient deionized water to make 100 percent.

and (II) applying the composition to said surfaces in a cleaning effective amount.

* * * * *